US009478334B2

(12) United States Patent
Park et al.

(10) Patent No.: US 9,478,334 B2
(45) Date of Patent: Oct. 25, 2016

(54) MAGNETIC MODULE FOR POWER INDUCTOR, POWER INDUCTOR, AND MANUFACTURING METHOD THEREOF

(71) Applicant: SAMSUNG ELECTRO-MECHANICS CO., LTD., Suwon, Gyunggi-do (KR)

(72) Inventors: Sang Soo Park, Gyunggi-do (KR); Young Ghyu Ahn, Gyunggi-do (KR); Jung Min Park, Gyunggi-do (KR); Min Cheol Park, Gyunggi-do (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 92 days.

(21) Appl. No.: 13/839,607

(22) Filed: Mar. 15, 2013

(65) Prior Publication Data

US 2014/0022041 A1 Jan. 23, 2014

(30) Foreign Application Priority Data

Jul. 18, 2012 (KR) ..... 10-2012-0078421

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 17/00*** | (2006.01) |

(Continued)

(52) U.S. Cl.

CPC ..... *H01F 5/00* (2013.01); *H01F 17/0013* (2013.01); *H01F 41/04* (2013.01); *H01F 41/046* (2013.01); *H01F 17/04* (2013.01); *H01F 27/292* (2013.01); *Y10T 29/4902* (2015.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | |
|---|---|---|---|
| 7,304,557 | B2 | 12/2007 | Tsuzuki et al. |
| 7,477,127 | B2 | 1/2009 | Kamijima |
| 7,843,303 | B2 | 11/2010 | Lu et al. |

(Continued)

FOREIGN PATENT DOCUMENTS

| | | | |
|---|---|---|---|
| CN | 1783366 | A | 6/2006 |
| CN | 1817070 | A | 8/2006 |

(Continued)

OTHER PUBLICATIONS

European Search Report EP 13275063.9 dated Dec. 9, 2013.

(Continued)

*Primary Examiner* — Tsz Chan
(74) *Attorney, Agent, or Firm* — McDermott Will & Emery LLP

(57) ABSTRACT

There is provided a power inductor including: a main body; and first and second external electrodes formed on both end portions of the main body, wherein the main body includes: upper and lower cover layers; at least one coil support layer having a through hole formed in a center thereof, at least one first recess portion formed in both lateral surfaces thereof and a plurality of second recess portions formed in respective corners thereof, and disposed between the upper and lower cover layers; and first and second coil layers formed on both surfaces of the coil support layer and having respective one ends thereof connected to the first and second external electrodes.

10 Claims, 8 Drawing Sheets

(51) Int. Cl.
*H01F 17/04* (2006.01)
*H01F 27/29* (2006.01)

(56) References Cited

U.S. PATENT DOCUMENTS

| | | | | |
|---|---|---|---|---|
| 8,058,964 | B2 | 11/2011 | Sato | |
| 2004/0263309 | A1 | 12/2004 | Ito et al. | |
| 2006/0068602 | A1 | 3/2006 | Kamijima | |
| 2006/0077029 | A1 | 4/2006 | Koschmieder | |
| 2006/0154052 | A1* | 7/2006 | Waffenschmidt et al. | 428/339 |
| 2006/0176138 | A1 | 8/2006 | Ito et al. | |
| 2007/0182519 | A1* | 8/2007 | Tsuzuki | H01F 17/0006 336/200 |
| 2008/0061917 | A1* | 3/2008 | Manoukian et al. | 336/200 |
| 2009/0251268 | A1* | 10/2009 | Sato | 336/200 |
| 2010/0001823 | A1 | 1/2010 | Kawarai | |
| 2010/0117777 | A1* | 5/2010 | Tan et al. | 336/65 |
| 2010/0141370 | A1* | 6/2010 | Lu et al. | 336/200 |
| 2010/0148909 | A1* | 6/2010 | El-Barbari et al. | 336/200 |
| 2010/0231344 | A1 | 9/2010 | Mashino | |

FOREIGN PATENT DOCUMENTS

| | | | | |
|---|---|---|---|---|
| CN | 1858864 | A | | 11/2006 |
| CN | 1910710 | A | | 2/2007 |
| CN | 101310346 | A | | 11/2008 |
| CN | 101517665 | A | | 8/2009 |
| CN | 101568978 | A | | 10/2009 |
| CN | 101752058 | A | | 6/2010 |
| EP | 1103993 | A1 | | 5/2001 |
| EP | 1965396 | A1 | | 9/2008 |
| JP | 2010205905 | A | * | 9/2010 |
| KR | 1999-0042250 | A | | 6/1999 |
| KR | 10-2006-0061709 | A | | 6/2006 |
| WO | 98/54733 | A2 | | 12/1998 |
| WO | 2005/004560 | A1 | | 1/2005 |
| WO | 2008/033316 | A2 | | 3/2008 |

OTHER PUBLICATIONS

Chinese Office Action issued in Application No. 201310104695.3 dated Apr. 20, 2016, with English translation.

* cited by examiner

MAGNETIC MODULE FOR POWER INDUCTOR, POWER INDUCTOR, AND MANUFACTURING METHOD THEREOF

CROSS-REFERENCE TO RELATED APPLICATIONS

This application claims the priority of Korean Patent Application No. 10-2012-0078421 filed on Jul. 18, 2012, in the Korean Intellectual Property Office, the disclosure of which is incorporated herein by reference.

BACKGROUND OF THE INVENTION

1. Field of the Invention

The present invention relates to a magnetic module for a power inductor, a power inductor, and a manufacturing method thereof.

2. Description of the Related Art

An inductor is a key passive element constituting an electronic circuit, together with a resistor and a capacitor. An inductor is used in a component or the like, to cancel noise or form an LC resonance circuit. Inductors may be classified as winding type inductors, laminated type inductors, thin film type inductors, and the like.

The winding type inductor may be formed by winding a coil around a ferrite core, or the like.

The winding type inductor may have stray capacitance between coils, and accordingly, in the case of increasing the number of turns of a coil to obtain higher inductance, degradation in high frequency characteristics may be caused.

A laminated type inductor may be formed by laminating a plurality of ferrite sheets.

In the laminated type inductor, coil-like metal patterns are formed on respective ferrite sheets, and the coil-like metal patterns may be sequentially connected by a plurality of conductive vias provided in the ferrite sheets.

The laminated type inductor is appropriate for mass-production and has excellent high frequency characteristics compared with a winding type inductor.

However, in the laminated type inductor, metal patterns are formed of a material having a low saturation magnetization value, and when the laminated type inductor is manufactured to have a small size, the number of laminations of the metal patterns is limited, resulting in lowered DC superposition characteristics and a failure to obtain a sufficient current.

A thin film type inductor may use a material having a high saturation magnetization value and even in the case that a thin film type inductor is manufactured to have a small size, an internal circuit pattern thereof may be easily formed in comparison to a laminated type inductor. Thus, recently, research into the thin film type inductor has been actively undertaken.

When a thin film type inductor is manufactured to be large, a coil may have a large thickness, thereby eliminating degradation in product characteristics due to an increase in series resistance.

However, when a thin film type inductor is manufactured to have a small size, an increase in the line width or thickness of a coil is limited, such that series resistance increases to degrade product characteristics.

Related Art Document 1 does not disclose a configuration in which recesses are formed in both surfaces of a substrate to lower series resistance while maintaining a certain inductance value.

RELATED ART DOCUMENT (Patent Document 1) Korean Patent Laid Open Publication No. 2006-0061709

SUMMARY OF THE INVENTION

An aspect of the present invention provides a power inductor capable of lowering series resistance while maintaining a certain level of inductance even in the case that the power inductor is small.

According to an aspect of the present invention, there is provided a power inductor including: a main body; and first and second external electrodes formed on both end portions of the main body, wherein the main body includes: upper and lower cover layers; at least one coil support layer having a through hole formed in a center thereof, at least one first recess portion formed in both lateral surfaces thereof and a plurality of second recess portions formed in respective corners thereof, and disposed between the upper and lower cover layers; and first and second coil layers formed on both surfaces of the coil support layer and having respective one ends thereof connected to the first and second external electrodes.

The coil support layer may have magnetic permeability of 80% or below.

An area ratio of the through hole to all of the second recess portions may be 0.60 or greater.

The first recess portion of the coil support layer may be formed as an elongated recess in a length direction of the coil support layer.

The first recess portion of the coil support layer may include a plurality of recess portions spaced apart from each other in a length direction of the coil support layer.

The first recess portion of the coil support layer may be formed to communicate with the second recess portions of the coil support layer.

The coil support layer may be a substrate formed of an insulating material or a magnetic material.

An insulating layer may be formed on a circumference of the first and second coil layers.

According to another aspect of the present invention, there is provided a magnetic module for a power inductor, including main bodies connected in a matrix form, wherein each of the main bodies includes: upper and lower cover layers; at least one coil support layer having a central through hole provided therein, at least one first recess portion formed in both lateral surfaces thereof and a plurality of second recess portions formed in respective corners thereof, and disposed between the upper and lower cover layers; and first and second coil layers formed on both surfaces of the coil support layer and having respective one ends exposed to the outside.

According to another aspect of the present invention, there is provided method of manufacturing a power inductor, the method including: preparing a substrate formed of an insulating material or a magnetic material and having a through hole in a center thereof, at least one first recess portion formed in both lateral surfaces thereof, and a plurality of second recess portions formed in respective corners thereof; forming first and second coil layers on both surfaces of the substrate; disposing the substrate having the first and second coil layers formed thereon, on a lower cover layer; forming a main body by forming an upper cover layer on the substrate; and forming first and second external electrodes on both end portions of the main body such that the first and second external electrodes are connected to portions of the first and second coil layers led thereto.

Before the disposing of the substrate, covering a circumference of the substrate having the first and second coil layers formed thereon, with an insulating material, may be performed.

The disposing of the substrate may include laminating a plurality of substrates on the lower cover layer.

In the preparing of the substrate, the first recess portion may be formed as an elongated recess in a length direction of the coil support layer.

In the preparing of the substrate, both lateral surfaces of the substrate may be removed to leave only portions thereof to form a plurality of first recess portions spaced apart from each other.

In the preparing of the substrate, the first recess portion may be formed to communicate with the second recess portions.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
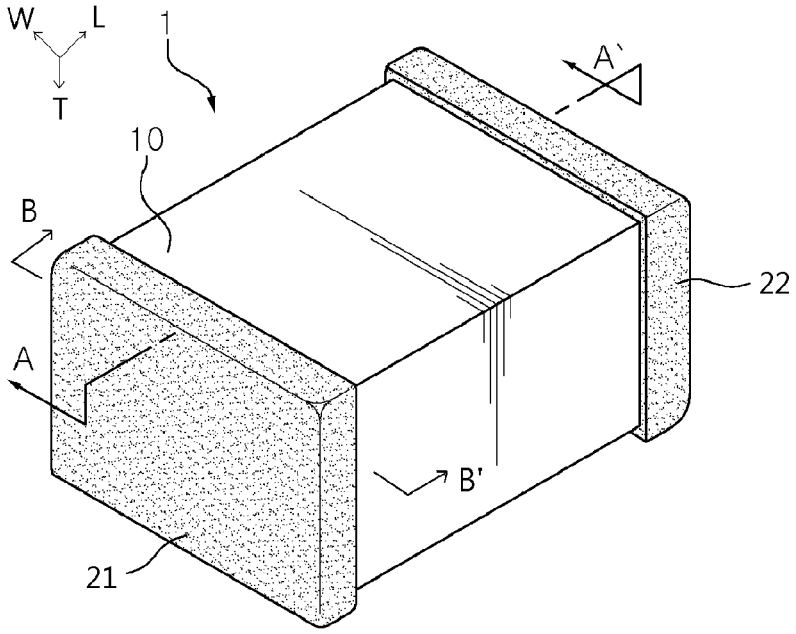
FIG. 1 is a perspective view of an inductor according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

Figure 2:
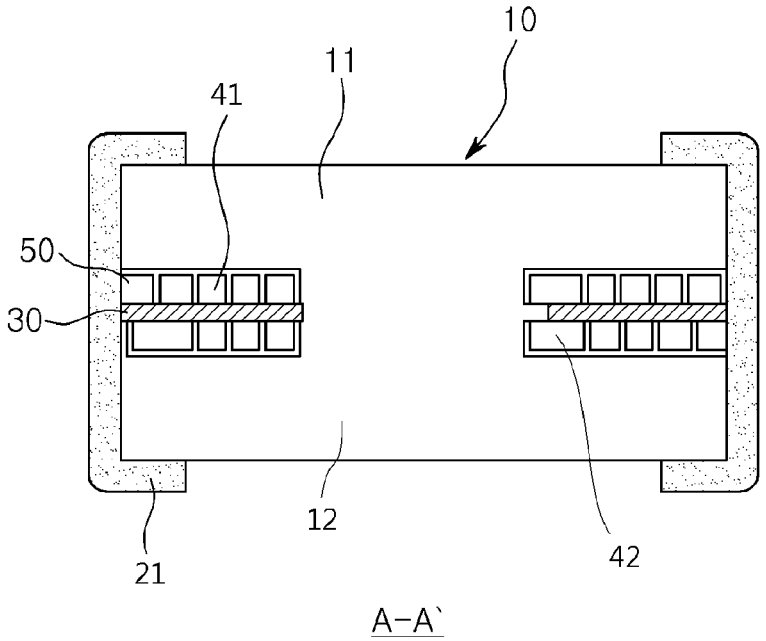
FIG. 2 is a cross-sectional view taken along line A-A' in FIG. 1.
Figure 3:
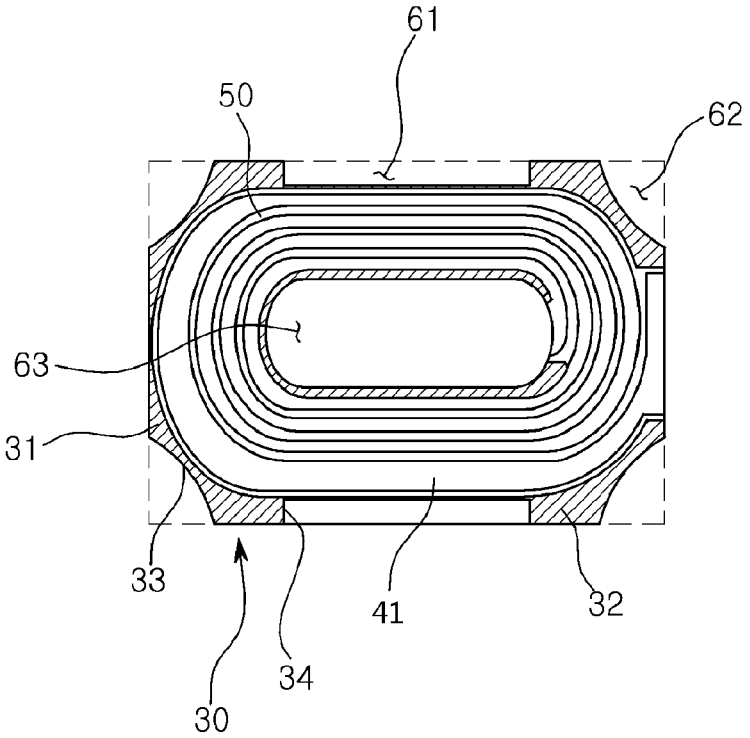
FIG. 3 is a cross-sectional view taken along line B-B' in FIG. 1.

Referring to FIGS. 1 through 3, an inductor 1 according to an embodiment of the present invention includes a main body 10 and first and second external electrodes 21 and 22 formed on both end portions of the main body 10.

In the following description, it will be defined that an "L direction" is a "length direction", a "W direction" is a "width direction", and a "T direction" is a "thickness direction" following directions of FIG. 1.

The main body 10 may have a rectangular parallelepiped shape and include upper and lower cover layers 11 and 12 formed of a magnetic material, a coil support layer 30 disposed between the upper and lower cover layers 11 and 12, and first and second coil layers 41 and 42 formed on both surfaces of the coil support layer 30 and having respective one ends electrically connected to the first and second external electrodes 21 and 22.

The upper and lower cover layers 11 and 12 may formed as substrates formed of a paste including a composite of a ferrite or metallic magnetic powder and a polymer, or including a magnetic material such as a nickel-zinc-copper ferrite.

The upper and lower cover layers 11 and 12 may serve to prevent basic electrical characteristics of the first and second coil layers 41 and 42 from being degraded.

The first and second external electrodes 21 and 22 may include a metal capable of providing electrical conductivity. For example, the first and second external electrodes 21 and 22 may include at least one metal selected from the group consisting of gold (Au), silver (Ag), platinum (Pt), copper (Cu), nickel (Ni), palladium (Pd), and alloys thereof.

Here, a nickel-plated layer (not shown) or a tin-plated layer (not shown) may be further formed on a surface of the first and second external electrodes 21 and 22 as necessary.

The coil support layer 30 may be fabricated as a substrate formed of, for example, an electrically insulating material such as a photosensitive polymer, or a magnetic material such as ferrite, or the like.

Also, a photosensitive insulating material may be interposed between the first and second coil layers 41 and 42 adjacent to each other, and the first and second coil layers 41 and 42 may be electrically connected by a conductive via (not shown).

The conductive via may be formed by forming a through hole (not shown) penetrating the coil support layer 30 in a thickness direction, and filling the through hole with a conductive paste, or the like.

In order to increase inductance, the number of turns of the first and second coil layers 41 and 42 should be increased or a length of the first and second coil layers 41 and 42 should be increased.

However, in order to increase inductance by an amount equal to the increased number of turns of the first and second coil layers 41 and 42, a certain size of the through hole 63 of the coil support layers 30 should be secured, so that there is a limitation in increasing the number of turns of the first and second coil layers 41 and 42.

Also, in the case in which a thickness of the first and second coil layers 41 and 42 is reduced to increase the number of turns of the first and second coil layers 41 and 42, resistance may be increased.

Meanwhile, in the case in which the length of the first and second coil layers 41 and 42 is increased, resistance may be increased in proportion thereto.

Thus, in the present embodiment, a structure of decreasing the length of the first and second coil layers 41 and 42 to reduce resistance, while maintaining inductance at a certain level, may be suggested as follows.

In the coil support layer 30, the through hole 63 may be formed in the center of the coil support layer 30, first recess portions 61 may be formed in both lateral surfaces thereof in the length direction, and a plurality of second recess portions 62 may be formed in respective corners thereof.

The coil support layer 30 has magnetic permeability lower than that of a magnetic material of the main body 10, and thus, magnetic flux may not be circulate smoothly to thereby lower inductance.

However, in the present embodiment, magnetic flux can be circulated smoothly through the through hole 63 and the first and second recess portions 61 and 62, whereby an increase in series resistance can be effectively restrained while preventing a degradation of inductance.

Table 1 below shows inductance changes over area ratios of the through hole 63 to the second recess portions 62. Here, an inductance change rate (%) denotes a ratio by which inductance values of sample 2 to sample 7 are decreased with respect to an inductance value of sample 1.

TABLE 1

| | Area of through hole | Area of second recess portions | Area ratio of through hole/second recess portions | Inductance (uH) | Inductance change rate (%) |
|---|---|---|---|---|---|
| Sample 1 | 0.902655 | 0.899 | 0.99 | 1.05 | 0 |
| Sample 2 | 0.902655 | 0.811 | 0.90 | 1.02 | 3 |
| Sample 3 | 0.902655 | 0.724 | 0.80 | 0.98 | 6 |
| Sample 4 | 0.902655 | 0.636 | 0.70 | 0.92 | 12 |
| Sample 5 | 0.902655 | 0.541 | 0.60 | 0.88 | 16 |
| Sample 6 | 0.902655 | 0.454 | 0.50 | 0.62 | 41 |
| Sample 7 | 0.902655 | 0.363 | 0.40 | 0.41 | 61 |

Referring to Table 1, it can be seen that when an area of the through hole is fixed to 0.902655, inductance may be changed according to an area ratio of the through hole 63 to the second recess portions 62.

In particular, in the case of sample 6 and sample 7 in which the area ratio of the through hole 63 to the second recess portions 62 is reduced to 50% or below, inductance is rapidly lowered from 0.88 in sample 5 to 0.62 and from 0.62 in sample 6 to 0.41. Also, the inductance change rate is sharply reduced from 16% in sample 5 to 41% and from 41% in sample 6 to 61%, and thus, it can be confirmed that the ratio of the through hole 63 to the second recess portions 62 needs to be 60% (0.60) or greater in order to maintain a certain inductance value.

The first and second coil layers 41 and 42 of the coil support layer 30 have a substantially helical structure and may have a polygonal shape such as a quadrangular shape, a pentagonal shape, a hexagonal shape, a circular shape, an oval shape, or the like. Also, the first and second coil layers 41 and 42 of the coil support layer 30 may have an irregular shape as necessary.

As illustrated in FIGS. 1 through 3, when the main body 10 is a rectangular parallelepiped, the first and second coil layers 41 and 42 may have a quadrangular shape to allow for the area of the first and second coil layers 41 and 42 to be significantly increased, such that a strength of an induced magnetic field may be significantly increased.

Respective one ends of the first and second coil layers 41 and 42 are led out to end portions of the coil support layer 30 so as to be electrically connected to the first and second external electrodes 21 and 22.

Also, the respective other ends of the first and second coil layers 41 and 42 may be positioned in the vicinity of the center of the coil support layer 30 so as to be electrically connected through a via conductor (not shown).

The first and second coil layers 41 and 42 may have magnetic permeability of 80% or below and may include at least one metal selected from the group consisting of gold (Au), silver (Ag), platinum (Pt), copper (Cu), nickel (Ni), palladium (Pd), and alloys thereof. The first and second coil layers 41 and 42 may be formed of any material, as long as the material may provide conductivity. Thus, the material of the first and second coil layers 41 and 42 is not limited to the listed metals.

Meanwhile, in order to insulate the first and second coil layers 41 and 42 and the main body 10, an insulating layer 50 may be formed on the circumference of the first and second coil layers 41 and 42 so as to cover surfaces of the first and second coil layers 41 and 42.

The insulating layer 50 is formed of a material having insulating characteristics. For example, the insulating layer 50 may be formed of a polymer, or the like, but the present invention is not particularly limited thereto.

Meanwhile, the first and second recess portions 61 and 62 formed in the coil support layer 30 may be variably modified as necessary.

FIGS. 4A through 4F illustrate portions of modifications of the first and second recess portions 61 and 62. Here, the through hole 63 of the coil support layer 30 is not illustrated for the purpose of description.

Figure 4A:
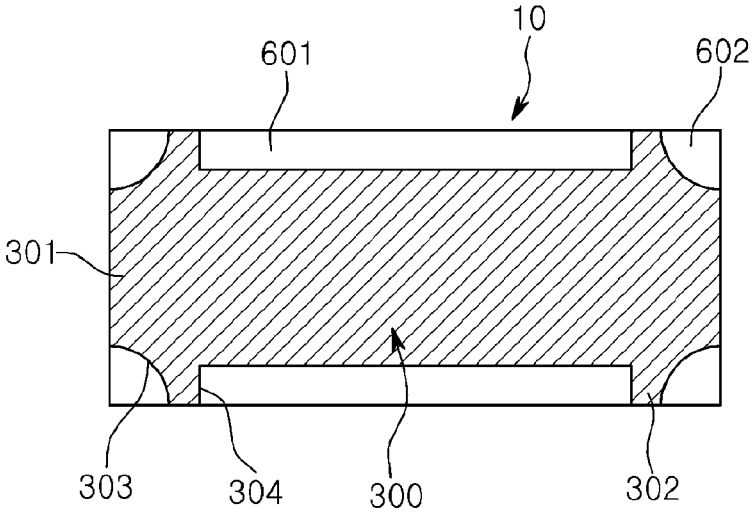
FIGS. 4A through 4F are plan views illustrating substrates of the inductor according to various modification embodiments of the present invention.

Referring to FIG. 4A, first recess portions 601 and second recess portions 602 may be spaced apart from each other by two pairs of first extending portions 302 led out to both surfaces of the coil support layer 300 and second extending portions 301 led out to both end portions of the coil support layer 300.

Here, each of the first recess portions 601 may be formed as a single elongated recess formed in the length direction of the coil support layer 300 by two first extending portions 302. An inner corner surface 304 of the first recess portion 601 may be formed as a right angle surface, but the present invention is not limited thereto.

Also, the second recess portions 602 may be formed in a chamfered manner on four corners of the coil support layer 300, and inner surfaces 303 thereof may be formed as curved surfaces, but the present invention is not limited thereto and the inner surfaces 303 of the second recess portions 602 may be formed as flat surfaces when necessary.

Figure 4B:
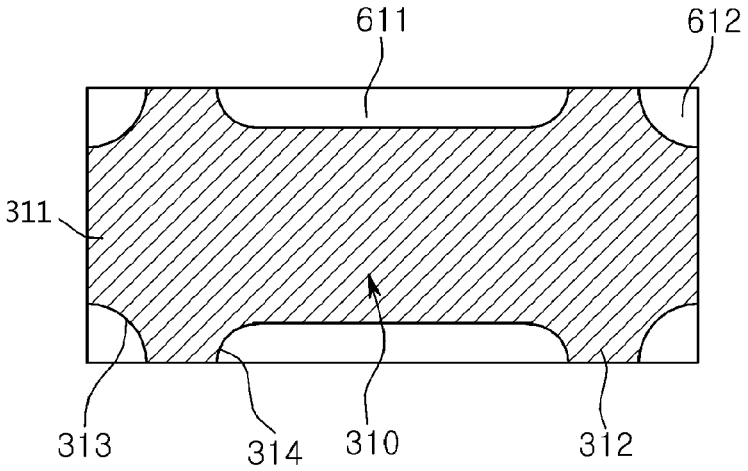

Referring to FIG. 4B, first recess portions 611 and second recess portions 612 may be spaced apart from each other by two pairs of first extending portions 312 led out to both lateral surfaces of a coil support layer 310 and second extending portions 311 led out to both end portions of the coil support layer 310.

Here, each of the first recess portions 611 may be formed as a single elongated recess formed in the length direction of the coil support layer 310 by the two first extending portions 312. An inner corner surface 314 of the first recess portion 611 may be formed as a curved surface, but the present invention is not limited thereto.

Figure 4C:
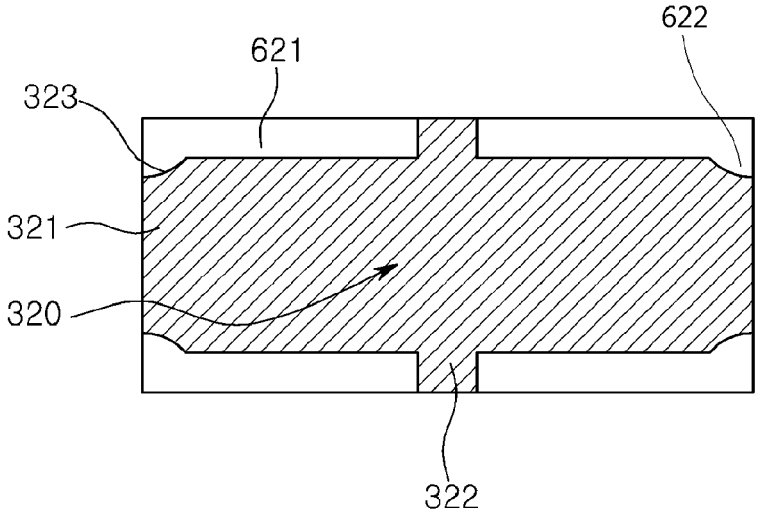

Also, the second recess portions 612 may be formed in a chamfered manner on four corners of the coil support layer 310, and inner surfaces 313 thereof may be formed as curved surfaces, but the present invention is not limited thereto and the inner surfaces 313 of the second recess portions 612 may be formed as flat surfaces when necessary Referring to FIG. 4C, first recess portions 621 and second recess portions 622 may be spaced apart from each other by a pair of first extending portions 322 led out to both lateral surfaces of a coil support layer 320 and second extending portions 321 led out to both end portions of the coil support layer 320.

Here, the first recess portions 621 may be two recesses spaced apart from each other in the length direction of the coil support layer 320 by the first extending portion 322. The first recess portion 621 and the second reception portion 622, adjacent to each other and divided by the second extending portion 321 may be formed to communicate with each other, but the present invention is not limited thereto.

Also, inner surfaces 323 of the second recess portions 622 may be formed as curved surfaces, but the present invention is not limited thereto and the inner surfaces 323 of the second recess portions 622 may be formed as flat surfaces when necessary.

Figure 4D:
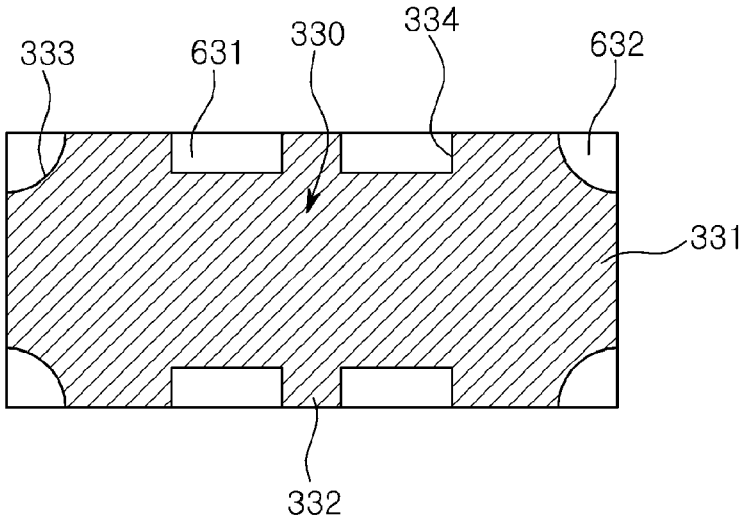

Referring to FIG. 4D, first recess portions 631 and second recess portions 632 may be spaced apart from each other by a plurality of first extending portions 332 led out to both lateral surfaces of a coil support layer 330 and second extending portions 331 led out to both end portions of the coil support layer 330.

Here, the first recess portions 631 may be a plurality of recesses spaced apart from each other in the length direction of the coil support layer 330 by the plurality of first extending portions 332. An inner corner surface 334 of the first recess portion 631 may be formed as a right angle surface, but the present invention is not limited thereto.

Also, the second recess portions 632 may be formed in a chamfered manner on four corners of the coil support layer 330, and inner surfaces 333 thereof may be formed as curved surfaces, but the present invention is not limited thereto and the inner surfaces 333 of the second recess portions 632 may be formed as flat surfaces when necessary.

Figure 4E:
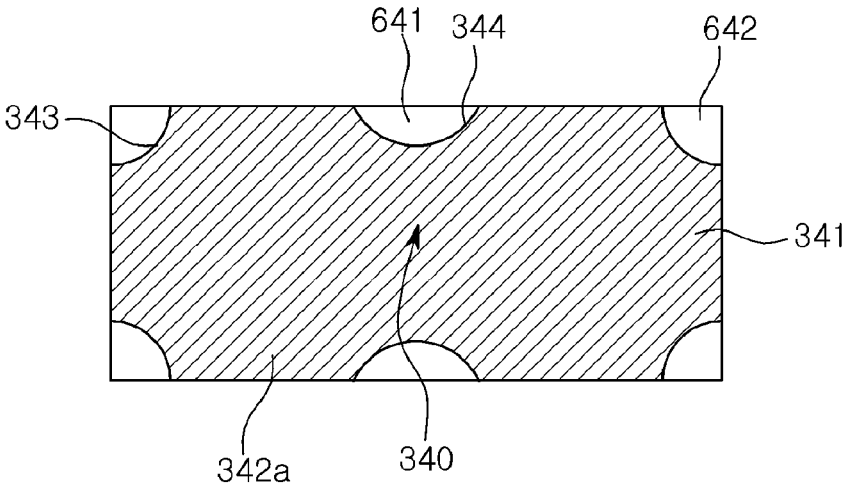

Referring to FIG. 4E, first recess portions 641 and second recess portions 642 may be spaced apart from each other by two pairs of first extending portions 342*a* led out to both lateral surfaces of a coil support layer 340 and second extending portions 341 led out to both end portions of the coil support layer 340.

Here, an inner corner surface 344 of the first recess portion 641 may be formed as a curved surface, but the present invention is not limited thereto.

Also, the second recess portions 642 may be formed in a chamfered manner on four corners of the coil support layer 340, and inner surfaces 343 thereof may be formed as curved surfaces, but the present invention is not limited thereto and the inner surfaces 343 of the second recess portions 642 may be formed as flat surfaces when necessary.

Figure 4F:
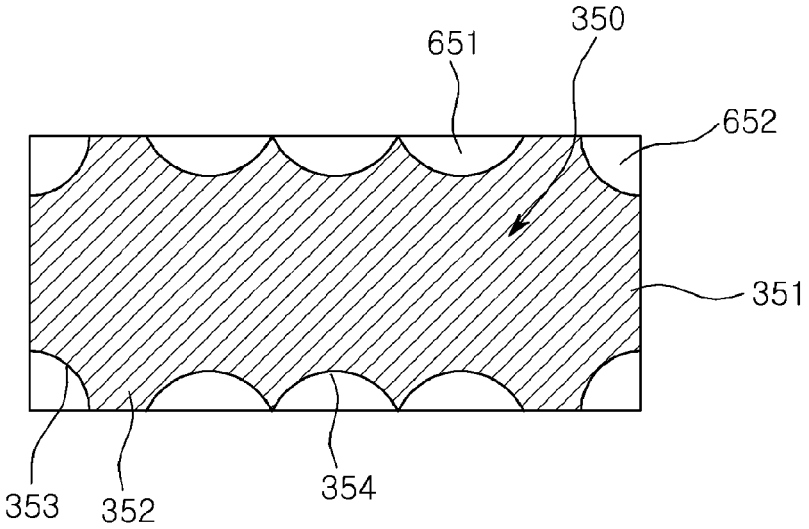

Referring to FIG. 4F, first recess portions 651 and second recess portions 652 may be spaced apart from each other by a plurality of first extending portions 352 led out to both lateral surfaces of a coil support layer 350 and second extending portions 351 led out to both end portions of the coil support layer 350.

Here, the first recess portions 651 may be a plurality of recesses spaced apart from each other in the length direction of the coil support layer 350 by the plurality of first extending portions 352, and an inner surface 354 of the first recess portion 651 may be formed as a curved surface, but the present invention is not limited thereto.

Also, the second recess portions 652 may be formed on four corners of the coil support layer 350 in a chamfered manner, and inner surfaces 353 thereof may be formed as curved surfaces, but the present invention is not limited thereto and the inner surfaces 353 of the second recess portions 652 may be formed as flat surfaces when necessary.

Figure 5:
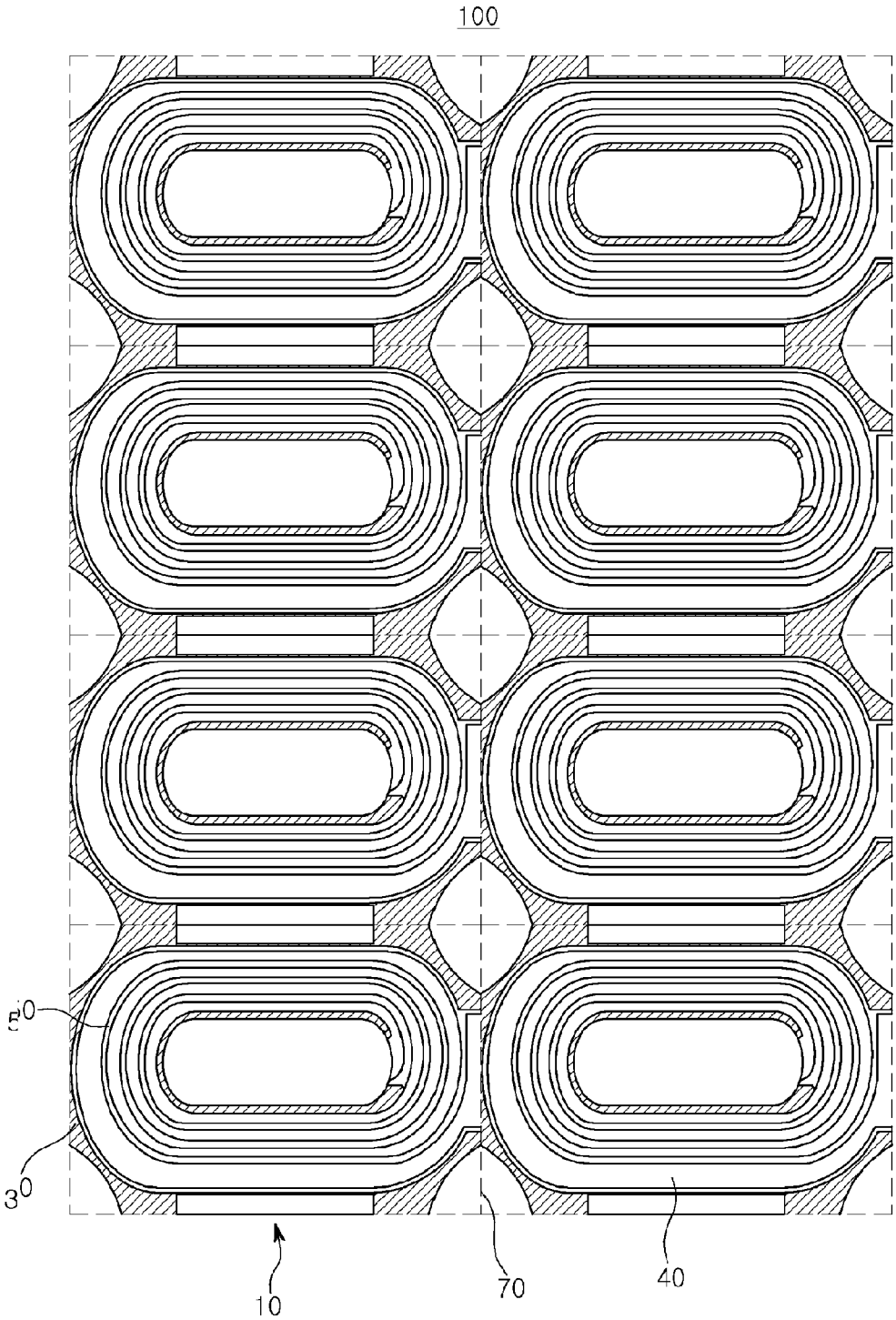
FIG. 5 is a plan cross-sectional view illustrating a structure of a magnetic module for a power inductor according to another embodiment of the present invention.
Figure 6:
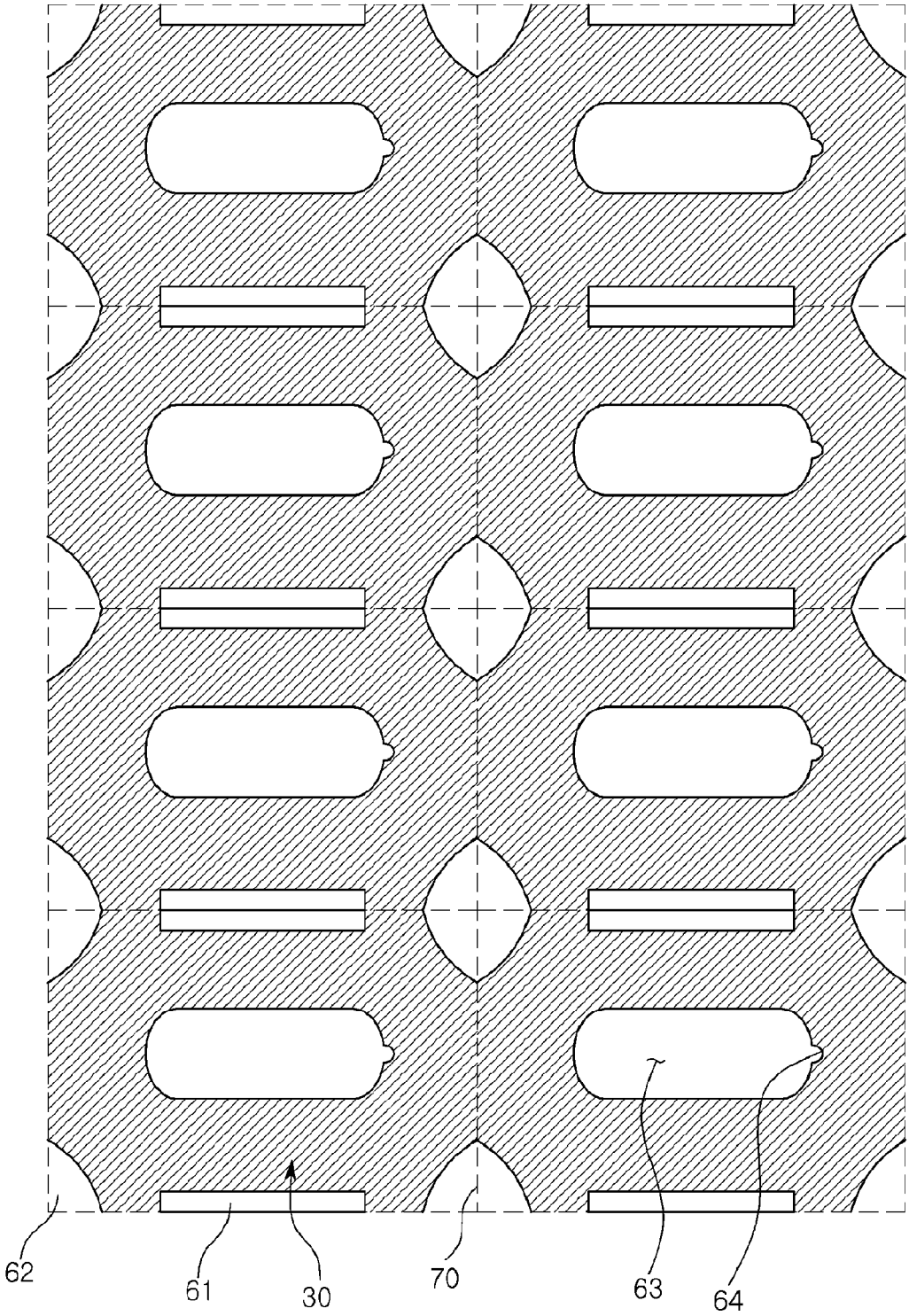
FIG. 6 is a plan cross-sectional view illustrating only a substrate in the structure of FIG. 5.

FIGS. 5 and 6 illustrate a magnetic module 100 for a power inductor in which a plurality of main bodies 10 are connected with each other in a matrix form before the first and second external electrodes 21 and 22 are formed on both end portions of each main body 10 in the power inductor 1 configured as described above.

Here, reference numeral 70 denotes a cutting line for cutting the magnetic module 100 into magnetic body units for manufacturing respective power inductors.

Figure 7:
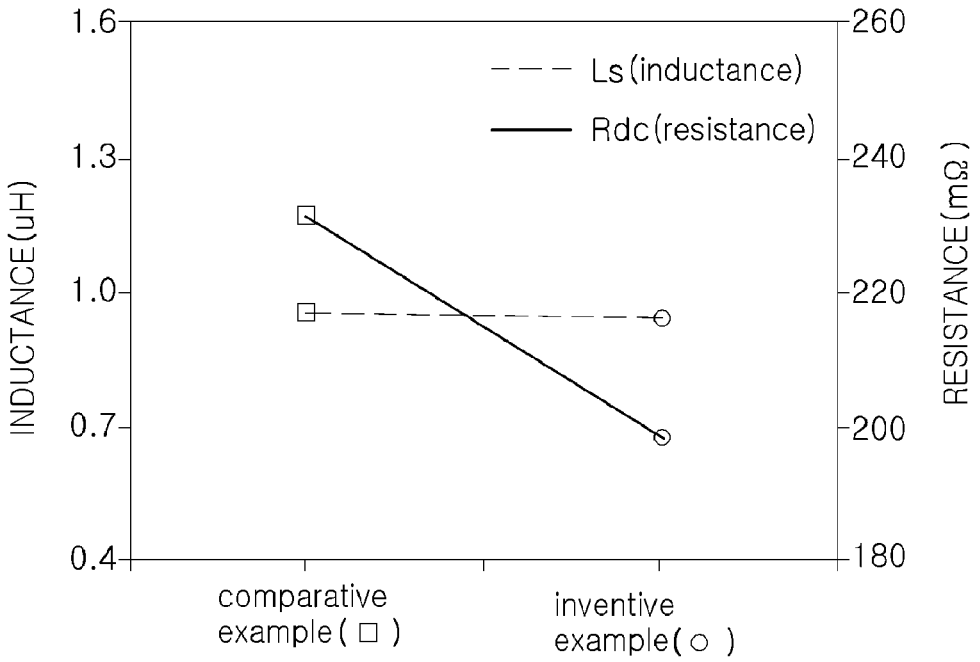
FIG. 7 is a graph showing a comparison of inductance and series resistance between the inductor according to the embodiment of the present invention and an inductor according to the related art.

FIG. 7 is a graph showing a comparison of inductance and series resistance between the inductor according to the embodiment of the present invention and an inductor according to the related art.

Referring to FIG. 7, an inductor according to the embodiment of the present invention (hereinafter referred to as an inventive example) which includes a recess for a magnetic flux circulation has inductance of 0.95 uH while an inductor according to the related art (hereinafter referred to as an related art example), without a recess for a magnetic flux circulation has inductance of 0.94 uH, and accordingly inductance of the inventive example is smaller than that of the related art example by about 1%.

Also, series resistance of the inventive example is 231.1 mΩ and that of the related art example is 198.8 mΩ, so it can be seen that series resistance of the inventive example of the present invention is greater than that of the related art example by about 14%.

In general, inductance is increased in proportion to the number of turns of a coil and a length of the coil, and series resistance is also increased in proportion to the number of turns of a coil and a length of the coil.

In case of the power inductor, it is necessary to maintain series resistance at as low a level as possible while satisfying a required inductance value, but in case of a large inductor, a coil may have a large thickness, eliminating degradation in product characteristics due to an increase in series resistance.

However, when the size of an inductor is reduced according to the tendency toward a reduction in size of products, there is limitations in increasing a thickness of a coil, and thus, series resistance is increased to degrade product characteristics.

In the embodiment, it can be seen that series resistance can be significantly lowered while a similar level of inductance is maintained owing to the through hole 63 and the first and second recess portions 61 and 62 formed in the coil support layer 30, in comparison to a thin film type power inductor according to the related art.

Thus, in the present embodiment, a product in which a size of a coil layer is increased to meet the requirements of inductance while reducing series resistance, even in the case that a size of the product is small.

Hereinafter, a method of manufacturing a power inductor according to an embodiment of the present invention will be described.

First, a substrate formed of an insulating material or a magnetic material is prepared. Here, the substrate refers to the coil support layer, and thus, it will be denoted by the same reference numeral 30.

The substrate 30 includes the through hole 63 in the center thereof, and at least one first recess portion 61 formed in both lateral surfaces thereof, and a plurality of second recess portions 62 formed in respective corners thereof to allow magnetic flux to circulate smoothly.

Here, the first recess portion 61 may be formed as an elongated recess in the length direction of the substrate 30 or may be formed as a plurality of separated recesses by cutting some portions of both lateral surfaces of the substrate 30 while leaving other portions thereof. Also, the first recess portion 61 and the second recess portion 62 may be in communication with each other as necessary.

Next, the first and second coil layers 41 and 42 are formed on both surfaces of the substrate 30.

The first and second coil layers 41 and 42 may be formed in the following order. That is, a conductive paste may be applied to one surface of the substrate 30 to form the first coil layer 41, a conductive via penetrating the substrate 30 is formed, and a conductive paste is applied to a surface opposite to the surface on which the first coil layer 41 is formed, to form the second coil layer 42. The first and second coil layers 41 and 42 may be electrically connected through the conductive via.

The conductive via may be formed by forming a through hole in the thickness direction of the substrate 30 by using a laser, a punching machine, or the like, and filling the through hole with a conductive paste, or the like.

Here, the conductive paste may include a metal able to provide electrical conductivity. For example, the conductive paste may include at least one metal selected from the group consisting of gold (Au), silver (Ag), platinum (Pt), copper (Cu), nickel (Ni), palladium (Pd), and alloys thereof.

Also, the first and second coil layers 41 and 42 and the conductive via may be formed of the same material in order to obtain stable electrical characteristics.

Thereafter, the substrate 30 having the first and second coil layers 41 and 42 formed thereon is disposed on the lower cover layer 12 formed of a magnetic material.

Here, a plurality of substrates 30 may be laminated in the thickness direction of the main body 10, and one end portions of the first or second coil layer 41 or 42 of the substrates 30, adjacent in the lamination direction, may be in contact with each other through a via conductor (not shown) so as to be electrically connected.

Also, an insulating layer may be formed of a material such as a polymer having insulating characteristics, or the like, to cover surfaces of the first and second coil layers 41 and 42 along the circumference thereof.

Thereafter, the upper cover layer 11 formed of a composite of ferrite or a metallic magnetic power and a polymer is formed on the substrate 30 having the first coil layer 41 formed thereon to manufacture the main body 10.

The upper cover layer 11 may be formed on the substrate 30 by further laminating a cover sheet formed of a material including a composite of ferrite or metallic magnetic powder and a polymer, or by casting a paste formed of the same material.

Thereafter, the first and second external electrodes 21 and 22 are formed on both end portions of the main body 10 such that they are electrically connected to the portions of the first and second coil layers 41 and 42 led thereto.

Here, the first and second external electrodes 21 and 22 may be formed by using a method of immersing the main body 10 in a conductive paste, a method of printing, depositing, or sputtering a conductive paste onto both end portions of the main body 10, or the like.

The conductive paste may be formed of a metal that may be able to provide electrical conductivity to the first and second external electrodes 21 and 22. For example, the conductive paste may include at least one metal selected from the group consisting of gold (Au), silver (Ag), platinum (Pt), copper (Cu), nickel (Ni), palladium (Pd), and alloys thereof.

A nickel-plated layer or a tin-plated layer may further be formed on the surfaces of the first and second external electrodes 21 and 22 as necessary.

As set forth above, according to embodiments of the invention, recesses for a magnetic flux circulation are formed in the center, both lateral surfaces, and respective corners of the coil support layers, whereby the power inductor having a low series resistance, while implementing high inductance characteristics, can be realized even in the case that the power inductor is small, and a manufacturing method thereof can also be realized.

While the present invention has been shown and described in connection with the embodiments, it will be apparent to those skilled in the art that modifications and variations can be made without departing from the spirit and scope of the invention as defined by the appended claims.

What is claimed is:

1. A power inductor comprising:

a main body; and first and second external electrodes formed on both end portions of the main body, wherein the main body includes: upper and lower cover layers; at least one coil support layer having a through hole formed in a center thereof, at least one first recess portion formed in both lateral surfaces thereof and a plurality of second recess portions formed in respective corners thereof, and disposed between the upper and lower cover layers; and first and second coil layers formed on both surfaces of the coil support layer and having respective one ends thereof connected to the first and second external electrodes, wherein the first recess portion of the coil support layer communicates with the second recess portions of the coil support layer, in which the second recess portions are grooved in farther than the first recess portion in a width direction of the coil support layer.

2. The power inductor of claim 1, wherein the coil support layer has magnetic permeability of 80% or less than that of the main body.

3. The power inductor of claim 1, wherein an area ratio of the through hole to all of the second recess portions in the coil support layer is 0.60 or greater.

4. The power inductor of claim 1, wherein the first recess portion of the coil support layer is formed as an elongated recess in a length direction of the coil support layer.

5. The power inductor of claim 1, wherein the first recess portion of the coil support layer includes a plurality of recess portions spaced apart from each other in a length direction of the coil support layer.

6. The power inductor of claim 1, wherein the coil support layer is a substrate formed of an insulating material or a magnetic material.

7. The power inductor of claim 1, wherein an insulating layer is formed on a circumference of the first and second coil layers.

8. A magnetic module for a power inductor, including main bodies connected in a matrix form, wherein each of the main bodies includes:

upper and lower cover layers;

at least one coil support layer having a central through hole provided therein, at least one first recess portion formed in both lateral surfaces thereof and a plurality of second recess portions formed in respective corners thereof, and disposed between the upper and lower cover layers; and first and second coil layers formed on both surfaces of the coil support layer and having respective one ends exposed to the outside, wherein the first recess portion of the coil support layer communicates with the second recess portions of the coil support layer, in which the second recess portions are grooved in farther than the first recess portion in a width direction of the coil support layer.

9. The magnetic module for a power inductor of claim 8, wherein the coil support layer has magnetic permeability of 80% or less than that of the main body.

10. The magnetic module for a power inductor of claim 8, wherein an area ratio of the through hole to all of the second recess portions in the coil support layer is 0.60 or greater.

* * * * *